United States Patent [19]

Salem

[11] Patent Number: 4,670,306

[45] Date of Patent: Jun. 2, 1987

[54] METHOD FOR TREATMENT OF SURFACES FOR ELECTROLESS PLATING

[75] Inventor: Robert A. Salem, Indianapolis, Ind.

[73] Assignee: Seleco, Inc., Indianapolis, Ind.

[21] Appl. No.: 773,848

[22] Filed: Sep. 9, 1985

Related U.S. Application Data

[63] Continuation of Ser. No. 532,364, Sep. 15, 1983, abandoned.

[51] Int. Cl.[4] ..... C23C 18/18; C23C 18/30

[52] U.S. Cl. ..... 427/258; 427/304; 427/305; 427/306

[58] Field of Search ..... 427/258, 304–306

[56] References Cited

U.S. PATENT DOCUMENTS

| | | | |
|---|---|---|---|
| 3,116,159 | 12/1963 | Fisher | 427/306 |
| 3,421,922 | 1/1969 | Wilson | 427/306 |
| 3,467,540 | 9/1969 | Schick | 427/306 |
| 3,562,038 | 2/1971 | Shipley | 427/306 |
| 3,978,252 | 8/1976 | Lombardo | 427/306 |
| 4,298,636 | 11/1981 | Künzig | 427/306 |
| 4,301,190 | 11/1981 | Feldstein | 427/306 |
| 4,457,977 | 7/1984 | Walles | 427/306 |
| 4,478,883 | 10/1984 | Bupp | 427/306 |

FOREIGN PATENT DOCUMENTS

| | | | |
|---|---|---|---|
| 1524717 | 9/1978 | United Kingdom | 427/306 |

*Primary Examiner*—John D. Smith

*Attorney, Agent, or Firm*—Woodard, Weikart, Emhardt & Naughton

[57] ABSTRACT

A method for the treatment of a substrate for electroless metal plating which includes the steps of applying onto at least a portion of the substrate a material selected for having adequate adherence to the substrate and for being suitably absorptive of an electroless plating catalyst. The coated surface is thereafter successively contacted with a plating catalyst, accelerator for the catalyst, and an electroless plating solution.

2 Claims, No Drawings

METHOD FOR TREATMENT OF SURFACES FOR ELECTROLESS PLATING

This application is a continuation of application Ser. No. 532,364, filed Sept. 15, 1983, now abandoned.

BACKGROUND OF THE INVENTION

1. Field of the Invention

The present invention relates to the field of electroless plating of a substrate, and more particularly to a method for treating a surface to facilitate electroless plating of the surface.

2. Description of the Prior Art

Electroless plating of various substrates have been well known in the art. The application of various types of electroless coatings, such as copper, cobalt, nickel, gold or palladium, is typically accomplished in a bath by chemical reduction of the metal, rather than by application of an electric current. The primary difficulty has been to prepare the non-conductive substrate to assure adequate adherence of the plating to the surface. It has also been a problem that certain plating techniques are not suitable for all types of substrates.

Electroless plating generally requires a so-called activation or catalyzation step during which a substrate surface, to be electrolessly plated, has placed thereon a material, usually a metal salt. This metal salt is capable of reducing the plated metal from an electroless bath without the use of an electrical current. Such a material serves as a reduction catalyst, and usually comprises the salts of the precious metals, namely palladium, platinum, gold, silver, iridium, osmium, ruthenium and rhodium.

Typically, the conventional processes include a first stage of etching or "microcrazing" the surface with a strong acid, such as a chromic acid. The etching solutions may also include sulphuric acid and sometimes phosphoric acid. The material to be plated is immersed in the acid bath to render the surface hydrophilic, and also to provide a keying effect to promote adhesion between the surface and subsequent coatings.

A problem with conventional electroless metal plating of hydrophobic surfaces, such as organic polymer surfaces, is that the etching often leads to an undesirable amount of surface roughness. Also, the need to handle and dispose of highly acidic and/or caustic materials presents difficulties.

Following the acid etching, the component is thoroughly rinsed to remove all traces of chromic acid. This rinsing is important as the presence of hexavalent chromium ions in subsequent solutions acts a poison in them. If such ions are retained by adsorption on the surface, they prevent it from receiving a uniform deposition of subsequent coatings. Therefore, multiple rinse tanks and spray rinses are usually employed, often with an intermediate immersion in an alkaline or acid solution.

The second stage of conventional processes is the activation or sensitization stage. The purpose is to provide active nuclei of the catalyst metal adsorbed onto the surface of the substrate. This stage is one approach may include immersion into a stannous chloride solution followed by rinsing and immersion into an activating bath containing in solution a catalytic precious metal, usually palladium. The activator, typically palladium chloride, reduces the $Pd^{++}$ on the surface of the article to $Pd^{\circ}$.

Alternatively, the material may be immersed in a solution containing both the tin salts and the precious metal, the "activator", followed by rinsing and immersing into a so-called "accelerator", usually a dilute acid solution, to modify the chemical nature of the tin component of the adsorbed activator. More particularly, there is employed a highly acidic solution of a noble metal colloid, typically a palladium colloid, maintained in suspension by a protective colloid, i.e. stannic acid colloids. Because the colloidal palladium as well as the protective colloid are co-adsorbed by the substrate, the article is immersed in an acidic or alkaline accelerator solution to remove the protective colloid and expose the adsorbed noble metal.

After water rinsing of the surface, the material is usually immersed into an electroless plating bath containing copper or nickel. The active precious metal nuclei act as a catalyst to produce a thin conductive metal coating on the surface.

Various modifications of this general procedure have been proposed by the prior art in an effort to improve the process and the resulting plating. In U.S. Pat. No. 3,983,267, issued to Norris on Sept. 28, 1976, there is described a process similar to that above described. However, the process is modified by including a step immediately following the acid etch in which the material is immersed in a reducing acid solution, preferably containing phosphorous, hypophosphorous or ortho-, hypo- or pyrophosphoric acids, and preferably including their alkali metal and/or ammonium salts as buffers. This process is said to make electroless plating available for such materials as polyphenylene oxides, ABS polymers and polyolefins.

The use of a linking agent immediately following the acid etching stage is disclosed in U.S. Pat. No. 3,993,848, issued to Feldstein on Nov. 23, 1976. The substrate surface is contacted with a linking agent for the stannous ion either prior to or concurrently with the priming step utilizing aqueous solution containing stannous and copper ions. The use of the linking agent is said to permit the use of lower amounts of stannous and copper ions while achieving improved plating and primer usefulness.

Particular sensitizing solutions have also been described in the prior art. In U.S. Pat. No. 3,960,573, issued to Zeblisky on June 1, 1976, there is discussed a sensitizing solution comprising a precious metal and a stoichiometric excess of a Group IV metal which is capable of two valence states. The solutions are stabilized against precious metal separation by adding a Lewis Base, e.g., hydroquinone or hydroxylamine. An alternative sensitizing solution including a complex of a precious metal salt with dimethyl sulfoxide, such as $PdCl_2.2(CH_3)_2SO$, together with a Group IV metal salt such as stannous chloride is described in U.S. Pat. No. 3,963,841, issued to Anschel et al. on June 15, 1976.

In U.S. Pat. No. 3,958,048, issued to Donovan et al. on May 18, 1976, there is described a method for electroless plating in which copper or nickel salts are converted for direct absorption onto the substrate surface. The purpose of this technique is stated to be an avoidance of the need to utilize noble metals which are relatively expensive and have other potential difficulties in use. The Donovan procedure employs a water soluble reactant capable of forming a water insoluble, catalytically active reaction product which is absorbable in the suspended state, provided by a water soluble organic suspending agent.

An alternative to the etching technique prior to activation is to incorporate and disperse an activating metal species such as palladium metal into the polymer surface either directly or through the use of an ink or resinous covering coat or layer. It has been found however that this incorporation does not lead to a continuous electroless metallization but on the contrary leads to a metallization having voids. This may be due to the fact that in these prior art techniques the dispersed palladium species is encapsulated by the polymer and is thus rendered dormant and must be revitalized to its catalytic state by being exposed to the surface. Such revitalization has been attempted by abrading the polymer surface or by etching the surface with mineral acids such as sulfuric or nitric acid. However, the need to conduct such an etching type of step significantly negates the expected advantage of seeding the metal into the plastic, which is intended in part to avoid the need to etch.

A procedure of this latter type is described in U.S. Pat. No. 4,035,500, issued to Dafter on July 12, 1977. In the Dafter patent there is disclosed a method which includes forming a dielectric coating containing an activating metal species on the surface of the substrate, and then reviving the metal species with chromic acid or ceric ammonium nitrate.

In U.S. Pat. No. 4,244,789, issued to Coll-Polagos on Jan. 13, 1981, there is described a method for metallizing materials which includes coating the substrate material with a hydrophilic composite material. The method is indicated as useful for producing metallized foams, embossing plates for reproduction of grains and textures, and decorative coatings for substrate materials. The hydrophilic composite material system includes a solvent, a film forming component, such as a vinyl chloride-vinyl acetate blend, and a hydrophilic component, such as polyvinylpyrrolidone. After application of the coating, the surface is contacted with water or a water solution of salts to produce a microporous surface by dissolving the water soluble, hydrophilic component.

An example of an electroless metal plating solution is described in U.S. Pat. No. 3,959,531, issued to Schneble et al. on May 25, 1976. The Schneble et al. composition includes, in combination, as ion of a metal whose electroless metal deposition is desired, a complexing agent for the ion, a reducing agent for said ion, a pH regulator, and less than about 25 parts per million of metal ions which have an oxidation potential greater than the oxidation potential of the ion of metal to be deposited.

The need for electroless plating of various substrates, particularly plastics, is continually growing. One application for this methodology is in the field of electromagnetic/radio frequency interference (EMI/RFI) coatings. The Federal Communications Commission has regulations that limit EMI/RFI for all digital electronic products that generate or use frequencies between 10 kHz and 1000 kHz, and include commercial, business or industrial products such as computers, cash registers, electronic typewriters and home products such as personal computers, video equipment, electronic games and calculators. This requirement has resulted at least in part due to the growing EMI/RFI from certain plastic unshielded electronic products that interfere with computers, pacemakers, radio/television, aircraft navigation and test instruments. Miniaturization of electrical devices has also stepped up sensitivity to small, spurious signals. As a result there is a present and increasing need for electroless plating methods which are suitable to a wide variety of substrates, and which are simple and reliable in operation.

SUMMARY OF THE INVENTION

Briefly describing one aspect of the present invention there is provided a method for the treatment of a substrate surface to facilitate electroless metal coating of the substrate. The surface of the substrate is first coated with a material having suitable absorptivity for an electroless plating catalyst. This coated surface is then successively contacted with the electroless plating catalyst and an accelerator for the catalyst, followed by plating the material with a metal by an electroless plating method.

It is an object of the present invention to provide a method for electroless plating of a substrate, particularly substrates which are not readily plated by other techniques.

Another object of the present invention is to provide a method for electroless plating which does not require a preparatory stage involving the acid etching of the substrate surface.

It is a further object of the present invention to provide a method for electroless plating which avoids the need for using, handling and disposing of chromic acid or the like, and which further eliminates the need for additional steps associated with applying and thereafter removing chromic acid or the like from the substrate.

It is another object of the present invention to provide a method for electroless plating which is simpler, more reliable, and less expensive than prior art methods.

A further object of the present invention is to provide a method for treating the surface of a substrate preliminary to plating with an electroless plating method.

It is another object of the present invention to provide a method for electroless plating, and a preliminary preparation for electroless plating, which yields an even and full coverage of the surface to be plated.

It is further object of the present invention to provide a method for selectively applying to only parts of a work piece an electroless metal plating.

Another object of the present invention is to provide a method for electroless metal plating which works with a great variety of substrates.

Further objects and advantages of the present invention will become apparent from the description of the preferred embodiment which follows.

DESCRIPTION OF THE PREFERRED EMBODIMENT

For the purpose of promoting an understanding of the principles of the invention, reference will now be made to the preferred embodiment and specific language will be used to describe the same. It will nevertheless be understood that no limitation of the scope of the invention is thereby intended, such alterations and further modifications in the invention, and such further applications of the principles of the invention being contemplated as would normally occur to one skilled in the art to which the invention relates.

The present invention relates to a novel method for treating the surface of a substrate to facilitate electroless plating of the surface. As will be further described herein, the method has a particular advantage in that it is applicable to a great variety of substrates and is generally useful with the various catalyst/accelerator approaches to electroless plating. In particular, the present invention has a distinct advantage in that the customary etching step prior to exposure of the substrate to the catalyst is made unnecessary, and the attendant problems of handling and disposing of the acid etch solution, and the cumbersome processing of the substrate during and following the etching, can all be avoided.

The first step involved in the present invention is to apply a coating of material onto the substrate surface intended to be plated. The coating is required to have two properties relating to operation of this invention, and determination of the presence of these properties may be readily made, without significant experimentation, based upon the following two explanations.

The coating material must first have adequate adherence to the substrate surface to which it is applied. The adequacy of the adherence may be readily determined following completion of the application of the coating, or after deposition of the metal plating. One simple method for evaluating the coating adherence is to place the adhesive side of a length of tape against the coating and to then pull the tape off of the substrate. A coating which adheres well to the substrate will not be removed with the tape, whereas a weaker adhering coating will at least partially be removed with the tape. Of course, the degree of adherence necessary for the coating will vary with different applications for the plating surface, but again can be readily determined based upon the applications.

The suitability of various types of coatings, such as paints, are typically known in the art with respect to adherence to the substrate. Although these coatings have not previously been used for the purpose described herein, the adherence characteristics will frequently be known for a given substrate. As an example, a preferred coating material for use with the present invention is an acrylic latex paint, which can be readily determined by literature available generally or from its manufacturer to adhere well to various substrates such as plastics. Consequently, the suitability of various coating candidates for a given substrate can be determined without undue experimentation, and an expansive list of various coatings useful with the present invention is therefore not provided herein.

It also follows that the variety for substrates with which the present invention is useful will include a great number, provided that the desired adherence of a qualified coating will result. For each substrate one or more of the available coatings will be useful with the adherence requirement being met. A variety of substrates are discussed in the references cited in the prior art section of this text, and the pertinent portions of these references is hereby incorporated by reference. The substrates for which the present invention is useful includes polymers such as polyphynelene oxide, acrylonitrile-butadiene-styrene (ABS), polystyrene, polycarbonate, epoxy resins, polyvinyl chloride, polyethylene, polypropylene, polyethylene oxide terephthalate, fluorine polymers such as polytetrafluoroethylene, and other natural and synthetic polymers. The substrate may also include other non-metallic materials such as silicate and non-silicate glasses, for example, quartz, soda lime float or plate glass, borosilicate, lead borate, aluminosilicate, alumina ceramic and tin oxide.

The second characteristic of the coating used in the present invention is that of suitable absorptivity for the electroless plating catalyst. A number of plating catalysts are well known in the art, and several are described in the patents cited in the prior art section of this text. The pertinent portions of these references are hereby incorporated by reference as detailing exemplary types of electroless plating catalysts for which the present invention is useful. The preferred catalyst for use with the present invention is a palladium chloride/-stannous chloride catalyst which is commonly known. One variation of this catalyst composition described in the Anschel patent, previously cited, includes a complex between a precious metal salt of a metal of the fifth and sixth periods of Group VIII, such as palladium, platinum, ruthenium and osmium, with dimethyl sulfoxide, together with a metal salt of Group IV, such as stannous chloride.

The basic requirement is that the coating have suitable absorptivity for the catalyst to absorb and retain a sufficient amount of the catalyst to give the desired results upon subsequent treatment with an accelerator and finally with the electroless plating solution. The preferred coating, comprising an acrylic latex paint, has been found to absorb the palladium chloride/stannous chloride catalyst well to yield excellent results in the finished, plated substate. The suitability of the coating with respect to absorption of the chosen catalyst will also depend to some extent on the catalyst which is selected, and such suitability can be readily determined.

It has been determined that a coating which has a flat appearance will generally speaking indicate a coating that will yield adequate adhesion of the electroless deposit. Further, the surface texture of the coating is a factor in the suitability of the coating for a given application, both with respect to having a texture which allows the electroless metal plating to have adequate adhesion to the coating, and with respect to having a texture which is desirable for the appearance of the final plated product.

The coating may be applied to the substrate by various, standard methods and equipment. The coating is preferably applied by spraying, although brushing or dipping are also applicable methods. The thickness of the coating may vary, provided that suitable characteristics as to adherence and absorptivity are achieved.

Following application of the coating, the substrate surface is then sequentially contacted with the electroless plating catalyst, an accelerator for the catalyst, and an electroless plating solution. These steps are well known in the art, and particularization as to the performance of these steps is therefore unnecessary herein. By way of example, the references cited herein describe various methods and solutions for the performance of these steps. In particular, the Schneble patent previously cited discusses a method and solution for the step of contacting a prepared surface with an electroless metal plating solution, and the pertinent portions of this reference are hereby incorporated by reference. In conventional fashion, a subsequent step of applying an electroplated metal coating onto the electroless plating may also be utilized with the present invention.

EXAMPLE I

An electroless plating operation for a newly molded part of ABS (acrylonitrile-butadiene-styrene copolymer) was performed by the following steps. An acrylic latex, water based paint was applied to the ABS substrate by spraying. The paint was a white enamel paint available from Lilly Industrial Coatings, Inc. of Indianapolis, Indiana under the designation "83523-2321 White LB WB Smooth." The paint is indicated as including butyl cellosolve, butyl carbitol, chertersol 2 and ammonia.

The paint was allowed to cure at 150°-160° F. for 30-45 minutes based upon the manufacturer's recommendation for the paint. The part was then contacted with a standard palladium chloride/stannous chloride catalyst solution for one minute. Subsequently the part was treated by conventional methods by immersion for three minutes in a standard accelerator solution available under the trademark "D-25" from McGean-Rohco, Inc. of Cleveland, Ohio, followed by immersion for six minutes in a standard electroless nickel plating solution also available from McGean-Rohco, Inc. under the designation "BESBON N-37". The ABS part had a good, uniform nickel plating on those portions sprayed with the acrylic latex coating.

This procedure was also followed, but substituting an electroless copper plating solution. It has been found that in this instance there was some difficulty caused by blistering of the coating. However, this was determined to relate to a proper application and curing of the coating itself, and not the subsequent processing as described herein. In this circumstance it was found preferable to apply the coating by spraying, which tends to give a relatively thin and more uniform coating of the substrate ABS. A similar difficulty was not detected when using the electroless nickel plating solution. Also, although the manufacturer's recommendation for application of this paint to a surface is that a coating of 2 mils be applied, it was found that no difference appeared to result by varying the thickness, except for the blistering previously mentioned, and application of two layers of coating worked as well as one.

The paint selected for this run was selected for its indication of good adherence to plastics. Also, the paint had a "flat" appearance, which has been previously noted as being one signal of a suitable coating material. Similar runs conducted with a glossy enamel paint did not work as well.

EXAMPLE II

The procedure of Example I was followed, with the exception that a polyphynelene oxide material available from General Electric under the trademark "NORYL" was substituted for the ABS substrate. The acrylic latex paint did not appear to adhere suitably to this substrate, and in fact failed the "tape test" described in the text. Consequently, the paint did not have the required adherence characteristics as previously described, and was not suitable for practicing the present invention.

This same procedure was again followed, except that the paint was modified by the addition of 10% by weight of N-methyl-2-pyrrolidone (empirical formula $C_5H_9NO$), available from GAF Corporation of Cincinatti, Ohio under the trademark "M-Pyrol". This chemical is marketed for various uses including as an additive for water base coatings, as a solvent for petrochemicals and resins, and as a formulating agent for coating, stripping or cleaning compounds.

The resulting paint mixture was found to have good adhesion for the polyphynelene oxide, and passed the "tape test" without difficulty. The cured coating was then processed as described in Example I to leave a metal plating on the substrate surface. The plating was uniform and adhered firmly to the polyphynelene oxide. Repetition of the method using the ABS substrate and the modified paint composition also yielded an excellent plating on the surface.

The above examples are repeated on a variety of substrates including polycarbonate, polystyrene, polyester, acrylics and wood with good results. Similarly, a variety of catalyst/accelerator systems are used with the above examples and yield good results.

EXAMPLE III

One advantage of the present invention is its usefulness in applying an electroless metal plating onto only selected areas of the substrate. The coating, such as the paint described in Examples I and II, can be readily applied to only selected areas upon which a coating is desired. The subsequent processing will only deposit the metal plating onto the areas so coated, and therefore will leave the remaining portions of the substrate "clean".

In contrast, prior art methods involving etching and the like could provide selective coating only with considerable difficulty, or not at all. The prior art technique would typically involve the application of a resist onto those areas not intended to be coated, thereby requiring the additional steps of applying and removing the resist. The present invention can also utilize the resist method to insure against the appearance of metal plating on portions of the substrate, but this is not generally necessary. In certain instances or for particular substrates, it may be desirable to apply such a resist if spontaneous plating occurs on portions of the substrate not desired to be plated.

It has also been found that the present invention does not require special preparation of the substrate prior to the initial coating process. Of course, it has already been indicated that such steps as the etching step need not be conducted for the present method. No other special cleaning steps are required in order to perform the present method.

It has been found, however, that under certain circumstances the inclusion of a cleaning step will help to prevent the appearance of spurious, non-adherent plating at undesired, and uncoated, areas. This tendency may be due to handling of the parts, and has been overcome in one instance by including a cleaning step following the application of the initial coating. The procedure of Example II was followed, except that immediately after the step of applying the modified paint as a coating on the polyphenylene oxide, the surface was cleaned with a vegetable soap available from Valley Products Co. Manufacturers of Memphis, Tenn. under the trademark "VALPRO GM". This granular compound comprises 92.0% by weight of an anhydrous soap. This cleaning was conducted by immersing the items for 15-30 seconds into an aqueous solution of the "VALPRO GM" at 110° F. For pieces not cleaned with the "VALPRO GM" there appeared some extraneous places of plating, some in the form of fingerprints. For those items cleaned with the "VALPRO GM" there were no extraneous areas of plating.

It was found that for the ABS substrate there did not appear to be any places of extraneous plating, apparently due to the nature of the substrate itself. In this circumstance, use of the cleaning step was not required. Of course, the cleaning step is useful as indicated for certain substrates, but is not essential since the appearance of spurious plating areas may not be of concern. The need or utility for the cleaning operation can be readily determined based upon noting if there is a tendency for the appearance of extraneous plating, and whether there is a concern from the standpoint of aesthetics or economics as to the degree of such plating occurrences.

It should be noted in this context that an additional advantage of the present invention is to permit the selective plating of areas of a substrate, which may be desirable both for aesthetic purposes and as an economization of the plating and other solutions. For example, EMI/RFI shielding is typically provided by including a metallic coating or shield on the inside of the plastic casing for such items as computers and calculators. The appearance of patchy plating on the exterior of such casings would not be desirable, and steps as outlined herein would be appropriate to prevent such.

EXAMPLE IV

Tests were conducted to examine the characteristics of different coatings for use with the present invention. As previously indicated, the Lilly Industrial Coatings paint 76523-1627E (a waterbase texture enamel) was found to give excellent results for the process. Other paints were also tried in accordance with the procedure of Example II, including paints available from Lilly Industrial Coatings under the designations 82525-343 (a waterbase surface coating) and 83523-2321 (a waterbase smooth enamel). Paints which had a "flat" appearance upon drying were found to have good absorptivity for the electroless plating catalyst, whereas paints having a glossy appearance did not absorb the catalyst well.

EXAMPLE V

A series of tests were run to evaluate possible additives for the coating material such as the acrylic latex paint. Various chemicals were deposited onto the polyphynelene oxide material used in Example II, these including tetrahydrofurfural alcohol, furfural alcohol, ethylene glycol methyl ether, ethylene glycol n-butyl ehter, diethylene glycol methyl ether, diethylene glycol n-butyl ether, and the "M-PYROL". A drop of each of these chemicals was deposited onto the polyphynelene oxide and after five minutes the substrate was observed for attack by the chemical. Only the "M-PYROL" was found to attack the "NORYL" material, and was found to be useful in promoting adhesion of the paint coating to the substrate.

EXAMPLE VI

A series of tests were conducted to evaluate various cleaning agents for treatment of the substrate following application of the coating. A number of parts were coated with the modified paint formula used in Example II and were then closed in the manner described previously prior to contact with the catalyst, accelerator and electroless plating solutions. Each of the following chemicals were tried and were found to permit adequate adherence of the plating to the coated portions of the test pieces: "JOY" dishwashing detergent, "MONTERIL 1000" in water, "TRITON X-100" in water, "VALPRO GM" in water at a concentration of 50 grams per liter, "TERGITOL 15-5-3" in water and "TERGITOL 15-5-12" in water. However, plating on the uncoated portions of the substrate (although not firmly adherent to these portions) was found to occur in the range of 65–80% for each of the chemicals tried except for the "VALPRO GM", which had only about a 5% plating on the uncoated portions.

What I claim is:

1. A method for the selective treatment of a portion of the surface of a substrate for electroless metal plating which comprises the steps of:

a. applying onto only a portion of the surface of the substrate a coating of a material, the material having the characteristics of suitable adhesion to the substrate surface and suitable absorptivity for an electroless plating catalyst, the coating material being a water-based, acrylic latex paint, the substrate thereby having a coated surface portion and an uncoated surface portion:

b. contacting the coated and uncoated surface portions of step a. with an electroless plating catalyst suitable to provide absorption of the catalyst by the coated portion but not by the uncoated portion;

c. contacting the catalyst-absorbed coating portion and the non-catalyst-absorbed uncoated portion of step b. with an accelerator for the catalyst; and d. electroless plating a metal onto the accelerated coated portion of step c.

2. The method of claim 1 in which the acrylic latex paint is combined with about 10% N-methyl-2-pyrrolidone.

* * * * *